US007798616B2

(12) United States Patent
Bruce et al.

(10) Patent No.: US 7,798,616 B2
(45) Date of Patent: Sep. 21, 2010

(54) FLUID EJECTION DEVICE METAL LAYER LAYOUTS

(75) Inventors: Kevin Bruce, Corvallis, OR (US); Joseph M. Torgerson, Philomath, OR (US); Trudy Benjamin, Portland, OR (US); Michael D. Miller, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 774 days.

(21) Appl. No.: 11/811,094

(22) Filed: Jun. 8, 2007

(65) Prior Publication Data

US 2007/0242110 A1 Oct. 18, 2007

Related U.S. Application Data

(63) Continuation of application No. 10/787,573, filed on Feb. 25, 2004, now Pat. No. 7,240,997.

(51) Int. Cl.
*B41J 2/045* (2006.01)

(52) U.S. Cl. ..... 347/71; 347/58

(58) Field of Classification Search ..... 347/71
See application file for complete search history.

(56) References Cited

U.S. PATENT DOCUMENTS 5,159,353 A 10/1992 Fasen et al.
5,187,500 A 2/1993 Bohorquez et al.
6,056,391 A 5/2000 Kasamoto et al.
6,491,377 B1 12/2002 Cleland et al.
6,616,268 B2 * 9/2003 Parish ..... 347/58
6,663,221 B2 * 12/2003 Anagnostopoulos et al. .. 347/40
2003/0222947 A1 12/2003 Tomozawa

FOREIGN PATENT DOCUMENTS

EP 1352744 10/2003
EP 04019439 6/2005
WO 02074545 9/2002

OTHER PUBLICATIONS

Tantalum.
Gold.

* cited by examiner

*Primary Examiner*—Matthew Luu
*Assistant Examiner*—Brian J Goldberg

(57) ABSTRACT

A fluid ejection device comprises a first metal layer and a second metallayer. The first metal layer comprises an address path portion and a nonaddress path portion. The second metal layer, which overlies the first metal layer, comprises a first portion which comprises a power conducting portion. The power conducting portion is routed only over the non-address path portion of the first metal layer.

19 Claims, 7 Drawing Sheets

FLUID EJECTION DEVICE METAL LAYER LAYOUTS

CROSS-REFERENCE TO RELATED APPLICATION

This is a continuation of application Ser. No. 10/787,573 filed on Feb. 25, 2004 now U.S. Pat. No. 7,240,997, which is hereby incorporated by reference.

BACKGROUND OF THE DISCLOSURE

Some fluid ejection devices, including, for example, inkjet printheads, have a vertical column of nozzles arranged in a column on a die and defining a swath area. Firing resistors located in a firing chamber below the nozzles are energized, thereby heating fluid in the chamber and causing it to expand and be ejected from the nozzle. Circuitry fabricated on a substrate structure using standard thin film techniques includes a conductive path for carrying electrical power for firing the firing resistors, address signal paths, logic elements, and firing transistors. This circuitry is used to properly energize and operate the firing resistors. Capacitive coupling between the address bus and the fire line or power bus can generate noise and degrade performance.

The cost of a fluid ejection device can be reduced by reducing the device die size. Such reduction, however, may adversely impact the size of power conduits, leading to increased energy variation and reduced print quality. Power conduits may comprise gold which is susceptible to delamination.

BRIEF DESCRIPTION OF THE DRAWINGS

Features and advantages of the invention will be readily appreciated by persons skilled in the art from the following detailed description of exemplary embodiments thereof, as illustrated in the accompanying drawings, in which.

DETAILED DESCRIPTION OF THE DISCLOSURE

Figure 1:
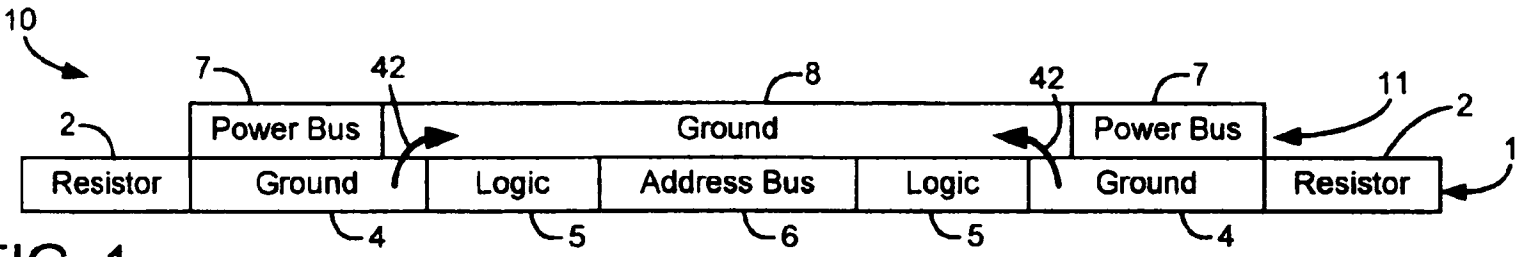
FIG. 1 illustrates a block diagram of relative positions of metal portions of an exemplary embodiment of a fluid ejection device.

In the following detailed description and in the several figures of the drawing, like elements are identified with like reference numerals.

Figure 2:
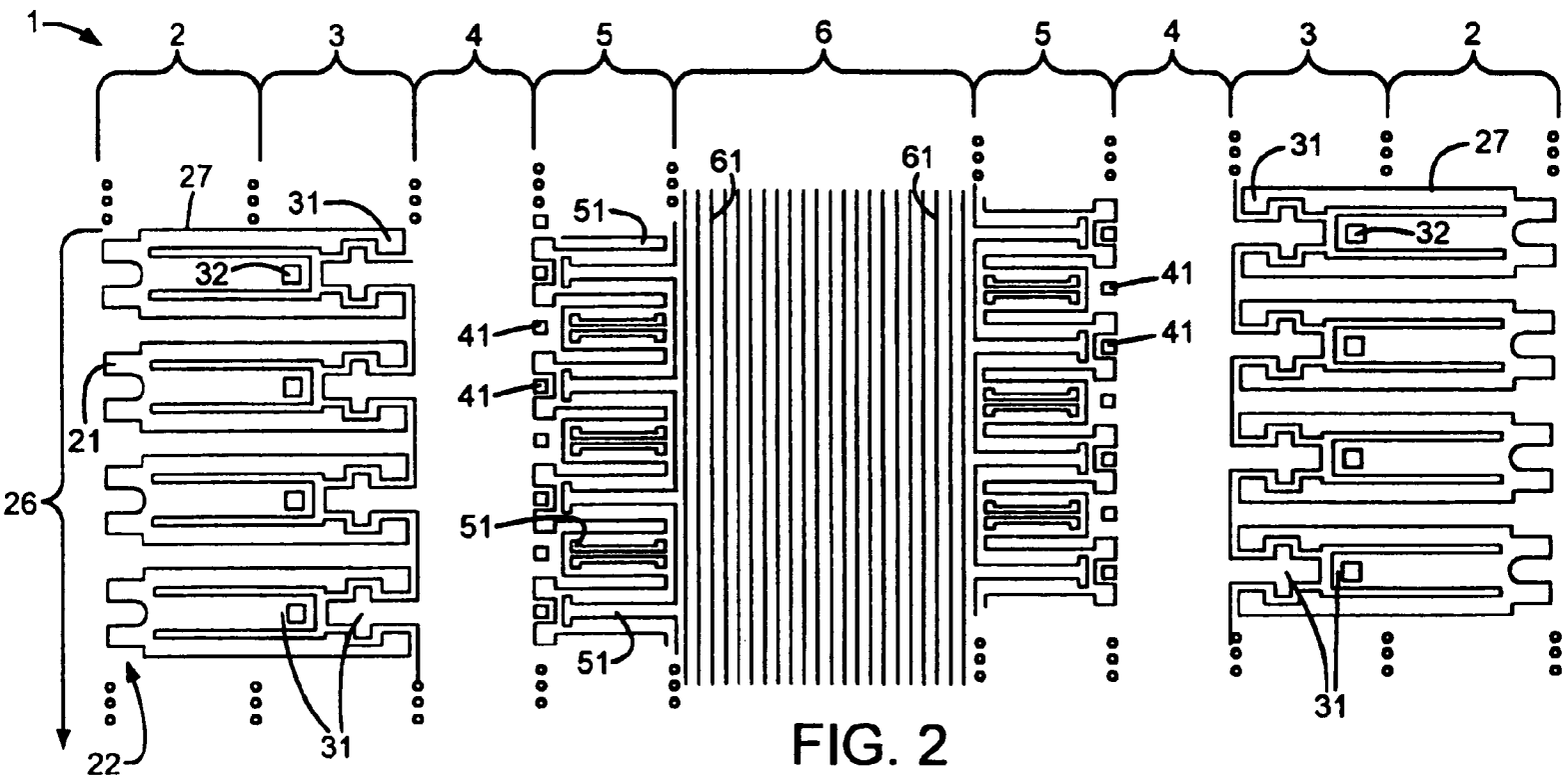
FIG. 2 illustrates an exemplary embodiment of a first metal layer of a fluid ejection device.

FIG. 1 illustrates a simplified cross-sectional view of relative positions of metal layer portions in an exemplary embodiment of metal layer layouts for an exemplary fluid ejection device. A thin film stack 10 comprises a first metal layer 1 and a second metal layer 11. The first metal layer 1 comprises at least an address path portion 6 and non-address path portions. The non-address path portions of the first metal layer 1 may comprise at least a resistor portion 2, a first-metal-layer ground portion 4, and a logic portion 5. In an exemplary embodiment, the first metal layer 1 comprises at least two each of the resistor portion 2, ground portion 4 and logic portion 5, arranged on opposite sides of the address path portion 6. The resistor portion 2 and associated nozzles (FIG. 10) define a swath height 26. The resistor portion 2 comprises a plurality of resistors 21 (FIG. 2). The address path portion 6 comprises an address bus, address lines or conductors, data paths, select or enable paths that are utilized to operate resistors that comprise resistor portion 2, as is known in the art. The address path portion 6 carries signals to logic elements, the logic elements causing particular firing transistors to cause particular corresponding firing resistors to fire in response to the signals. The logic elements include components such as transistors that provide functionality for address signal generation, fire signal coupling, select signal generation, synchronization signal generation and the like.

The thin film stack 10 of FIG. 1 also comprises a second metal layer 11 over the first metal layer 1. The second metal layer 11 comprises at least a power conducting portion 7 and a second-metal-layer ground portion 8. The power conducting portions 7 comprise conductive paths, fire lines or power busses for providing an electrical connection to the source of electrical power for firing the resistors 21. In an exemplary embodiment, the second metal layer comprises at least two power conducting portions 7 arranged on opposite sides of the ground portion 8. The power conducting portions 7 are routed, at least in part, over the first-metal-layer ground portions 4 in the first metal layer. The second-metal-layer ground portion 8 is routed through the swath height, substantially parallel with the column 22 of resistors 21, and over and over the logic portions 5 and the address path portion 6 of the first metal layer 1. The outboard edges of the second-metal-layer ground portion 8 overlap the inboard edges of the first-metal-layer ground portions 4. Conductive vias 41 (FIGS. 2-4) provide electrical connections 42 between the first-metal-layer ground portions 4 and the second-metal-layer ground portion 8 in the second metal layer 11.

By arranging the layout or topology of the first and second metal layers 1, 11 so that the power conducting portions 7 are not routed over, i.e. do not overlie or overlap, the address path portion 6, the opportunity for noise generation and degraded performance, caused by capacitive coupling between power conducting portions and address path portions, is reduced.

Routing the second-metal-layer ground portion 8 through the area of the second metal layer 1,1 that overlies logic portions 5 and the address path portion 6 of the first metal layer 1, may result in reduced energy variation due to decreased ground resistance resulting from the greater ground area. Providing the second-metal-layer ground portion 8 in the second metal layer avoids costs associated with increased die sizes which result where ground resistance is decreased by widening ground paths in the first metal layer, with corresponding increases in the die size. Routing the second-metal-layer ground portion 8 through the swath height may also increase the improvements in energy variation that can be achieved by increasing the thickness of the second metal layer 11.

FIG. 2 illustrates a top view of an exemplary layout or topology of a first metal layer 1 of an exemplary embodiment of a fluid ejection device. The first metal layer 1 is deposited on a substrate structure. The first metal layer 1 is masked and etched to define and fabricate the desired layout and topology of the first metal layer 1 of a portion of fluid ejection device circuitry.

The first metal layer defines and comprises resistor portions 2, transistor portions 3, first-metal-layer ground portions 4, logic portions 5 and an address path portion 6. The resistor portions 2 each comprise a plurality of individual resistors 21. In an exemplary embodiment, the resistor portions 2 also comprise heater legs 27 extending beyond the edges of an underlying transistor to provide an electrical connection to the individual resistors 21.

In an exemplary embodiment, the resistor portions 2 may be about 168 μm wide, the resistors being about 75 μm wide and the heater legs 27 extending about 93 μm outward from the edge of an underlying drive transistor. In an exemplary embodiment, the transistor portions 3 may be about 156 μm wide, the logic portions 5 about 126 μm wide and the address path portion about 206 μm wide. In the exemplary embodiment of FIG. 2, the first-metal-layer ground portion 4 is routed over the drive transistors. In an exemplary embodiment, the ground portion is about 96 μm wide. These dimensions are for one exemplary embodiment; other embodiments may employ other sizes and dimensions.

In an exemplary embodiment, the resistors 21 are formed, in part, by etching away at least the conductive layer portion from the resistor portion of the first metal layer. The resistors 21 are arranged in columns 22, although they can be rows as well. FIG. 2 shows eight representative resistors 21 in a column 22. A column of resistors may comprise any number of resistors. In exemplary embodiments, a column of resistors can comprise, for example, 100 resistors or 168 resistors.

Figure 3:
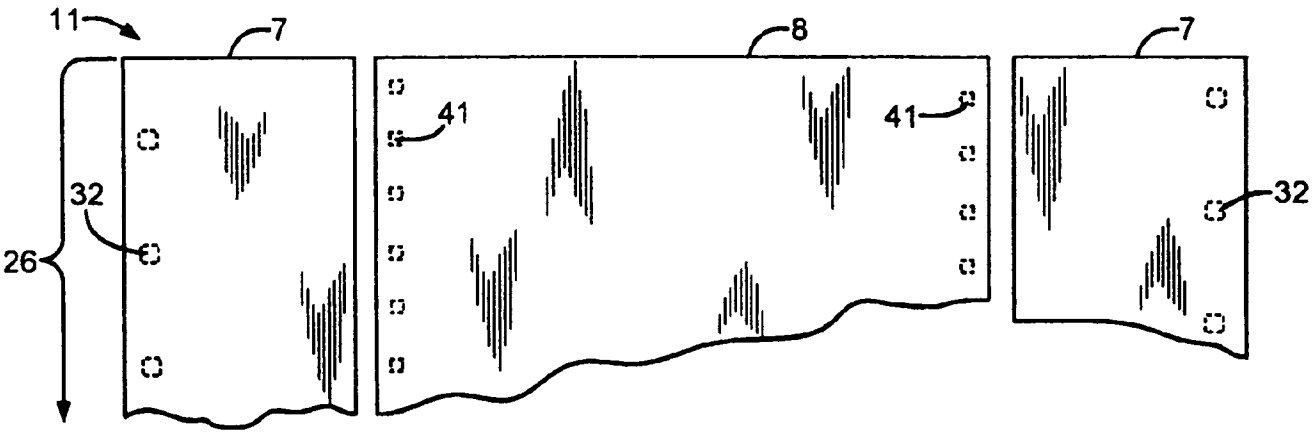
FIG. 3 illustrates an exemplary embodiment of a second metal layer of the fluid ejection device of FIG. 2.

The transistor portions 3 comprise drive transistor metal portions 31 of individual drive transistors associated with corresponding resistors 2. The drive transistor metal portions 31 are shown with representative, exemplary shapes. It is understood that the details of the form depends on the particular layout and design of the drive transistors. Conductive vias 32 connect the drive transistor metal portions 31 to overlying power conducting portions 7 (FIG. 3). The drive transistor metal portions 31 connect resistors 21 to a source of electrical power, and connect source and drain portions of the drive transistors to the resistors 21 and to the ground portions 4 through vias or PSG contacts through underlying layers (not shown), for example through PSG, poly and/or gate oxide layers.

The ground portions 4 comprise a common ground connection or path to ground running between the drive transistor metal portions 31 and the logic portion 5. Ground vias 41 electrically connect the first-metal-layer ground portions 4 to a second-metal-layer ground portion 8 (FIG. 3) in an overlying second metal layer.

The logic portion 5 comprises logic element metal portions 51 for individual logic elements 53 (FIG. 4) which are associated with corresponding drive transistors 33 (FIG. 4) and resistors 21. In an exemplary embodiment, the address path portion 6 comprises a plurality of address path portions 61 which carry signals to the logic elements 53, which determine which of the individual firing resistors 21 are to be energized. For each resistor 21, corresponding drive transistors 33 and logic elements 53 operate together to receive and interpret signals from the address path portions and to switch power to the resistor to fire the resistor at appropriate times, responsive to the address signals.

Figure 4:
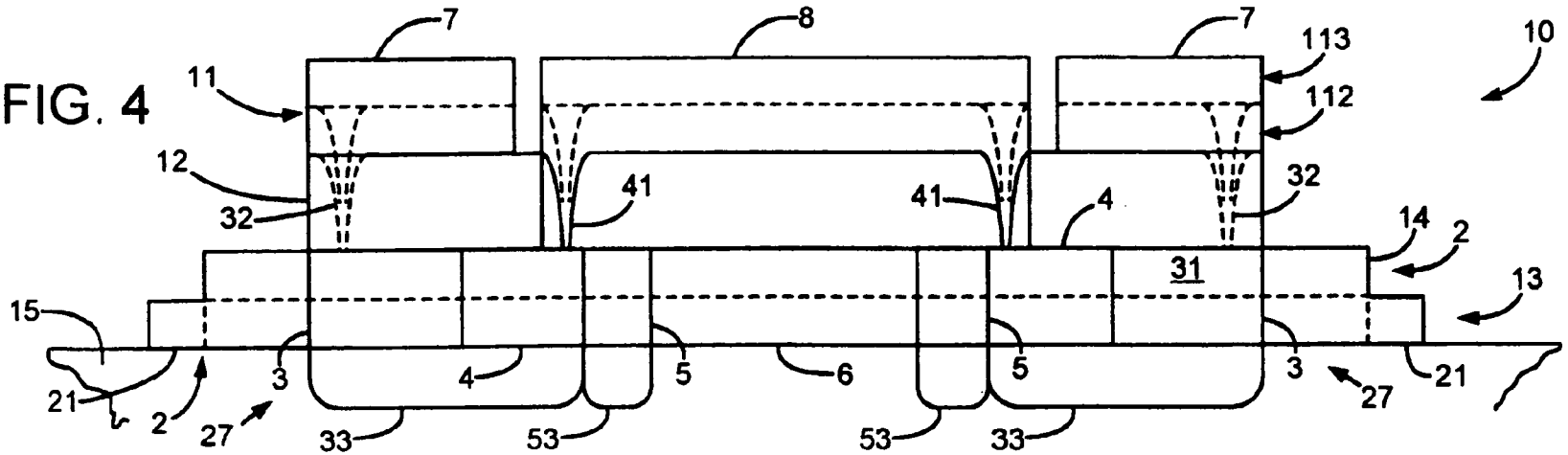
FIG. 4 is a block diagram of relative positions of portions of an exemplary embodiment.

FIG. 3 illustrates a top view of an exemplary topology of a second metal layer 11 corresponding to the exemplary embodiment of FIG. 2. The second metal layer 11 overlies the first metal layer 1 (FIG. 2) and is deposited and fabricated using thin film techniques. The second metal layer 11 comprises power conducting portions 7 and a second-metal-layer ground portion 8. The power conducting portions 7 and the second-metal-layer ground portion 8 comprise and are defined by conductive layer portions of the second metal layer, for example, gold. The second metal layer 11 may also comprise a second conductive layer portion 112 underlying first conductive layer portions 113, as shown in FIG. 4. In the exemplary embodiment of FIG. 3, the second-metal-layer ground portion 8 and the power conducting portions 7 comprise conductive layer portions and second conductive layer portions with substantially the same topology. In an exemplary embodiment, the second conductive layer portions may extend beyond the outside edges of the conductive layer portions, for example about 4 μm beyond the edges of the conductive layer portions.

The power conducting portions 7 are routed over, at least in part, the non-address path portions. In the embodiment of FIG. 3, for example, the power conducting portions 7 are routed over at least a portion of the drive transistor portion 3, for example over at least a portion of the drive transistor metal portions 31 and a portion of the ground portion 4 (FIG. 2). The second-metal-layer ground portion 8 is routed alongside and between the columns 22 of resistors 21 in the first metal layer 1, over the logic portions 5 and address portion 6 of the first metal layer 1 (FIG. 2). In this exemplary embodiment, the power conducting portions 7 do not overlie any portion of the address path portion 6 (FIG. 2). In an exemplary embodiment, the power conducting portions 7 are about 196 μm wide and the second-metal-layer ground portion 8 is about 475 μm wide.

FIG. 4 illustrates a diagram of relative positions of the first metal layer portions and the second metal layer portions of a thin film stack 10 of an fluid ejection device for the exemplary embodiments shown in FIGS. 1-3. The first metal layer 1 comprises the firing resistor portions 2, transistor portions 3, including the drive transistor metal portions 31 and the ground portions 4, logic portions 5, and the address path portion 6.

The first metal layer 1 comprises a resistive layer portion 13 and a conductive layer portion 14. In an exemplary embodiment, the resistive layer portion comprises TaAl and the conductive layer portion comprises AlCu. A passivation layer 12 separates the first metal layer 1 from the second metal layer 11. In an exemplary embodiment, the passivation layer 12 comprises, for example, SiC and/or SiN.

The first metal layer 1 is deposited on a substrate structure 15. In an exemplary embodiment, the substrate structure 15 includes a silicon substrate, gate oxide layer, doped regions, PSG and poly layers (not shown). Drive transistors 33 and logic elements 53 are defined in the substrate structure 15. The transistor portions 3 overlie at least a portion of the drive transistors 33 and the logic portions 5 overlie the logic elements 53.

The second metal layer 11 comprises power conducting portions 7 and a second-metal-layer ground portion 8. The second-metal-layer ground portion 8 overlies the address path portion 6, logic element metal portions 5 and the inboard edges of the ground portions 4. The second-metal-layer ground portion 8 is connected to the ground portions 4 by conductive vias 41. The power conducting portions 7 do not overlie the address path portion 6. The power conducting portions 7 are connected to the drive transistor metal portions 3 through conductive vias 32.

The second metal layer comprises at least a first conductive layer portion 113 and may further comprise a second conductive layer portion 112. The second conductive layer portion 112 has a resistivity which is greater than the resistivity of the first conductive layer portion 113. In an exemplary embodiment, the first conductive layer portion 113 comprises gold, which may have a resistivity of about 0.08 Ohm/sq. In an exemplary embodiment, the first conductive layer portion 113 may compromise a layer of gold about 0.36 μm thick. In other embodiments, the first conductive layer portion 113 may compromise a layer of gold with a thickness within a range of about 0.3 μm to about 1.5 μm. The first conductive layer portion 113 may comprise AlCu.

In an exemplary embodiment, the second conductive layer portion 112 comprises tantalum, which may have a resistivity of about 60 ohm/sq. The second conductive layer portion 112 may comprise a layer of tantalum about 0.3 μm thick. In other embodiments, the layer of tantalum may have a thickness within a range of about 0.0 to 0.5 μm. The second conductive layer portion may comprise, for example, tantalum. Depositing a tantalum layer portion 112 before depositing a gold layer portion 113 may improve the adhesion of the gold layer.

Figure 5A:
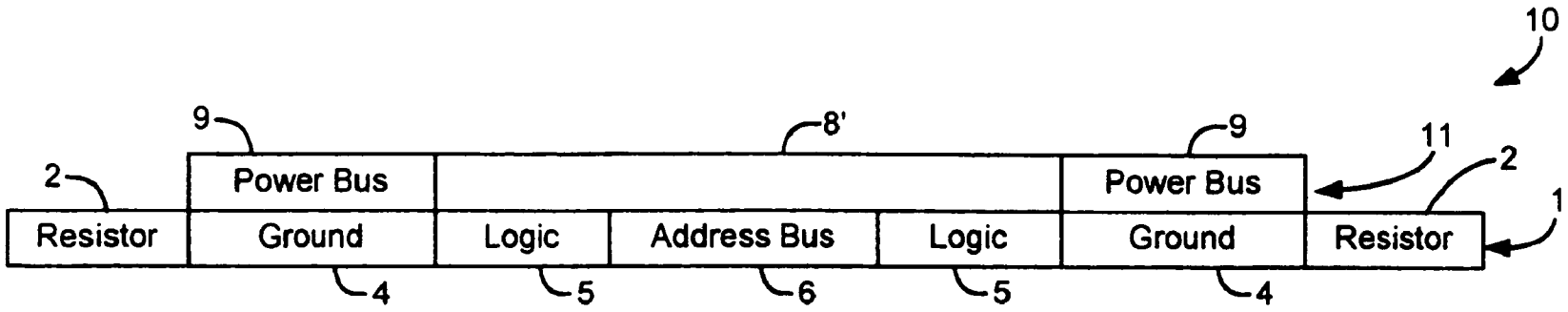
FIGS. 5A and 5B are block diagrams of relative positions of metal portions of an alternate exemplary embodiment of a fluid ejection device.
Figure 6:
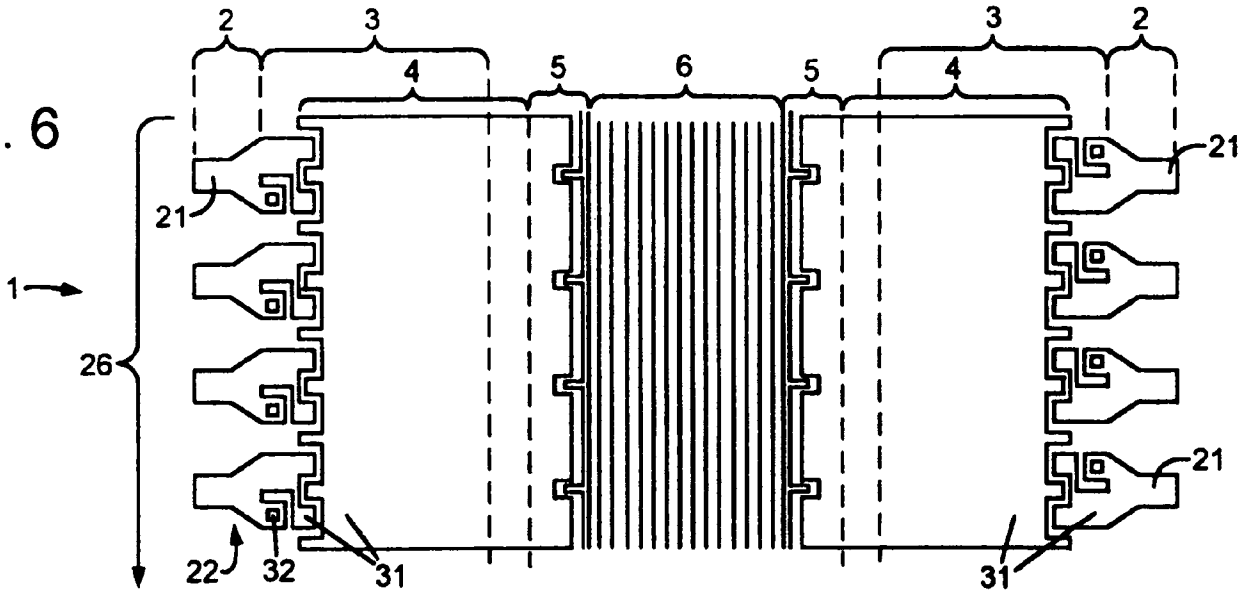
FIG. 6 illustrates an exemplary embodiment of a first metal layer of a fluid ejection.

FIG. 5A illustrates a simplified illustration of the relative layout of metal layer portions in an alternate exemplary embodiment of a thin film stack 10 of an exemplary fluid ejection device. The thin film stack 10 comprises a first metal layer 1 and a second metal layer 11. The first metal layer 1 comprises at least a resistor portion 2, a first-metal-layer ground portion 4, a logic portion 5 and an address path portion 6. In an exemplary embodiment, the first metal layer comprises at least two each of a resistor portion 2, ground portion 4, and the logic portion 5, arranged on opposing sides of the address path portion 6. The resistor portions 2 each comprise a column 22 of individual resistors 21 (FIG. 6).

The second metal layer 11 comprises at least a power conducting portion 9 and a second conductive portion 8'. The second conductive portion 8' is electrically isolated from the power conducting portion 9. The second conductive portion 8' is routed over the address path portion 6 and logic portions 5. In an exemplary embodiment, the second metal layer 11 comprises at least two power conducting portions 9, arranged on opposed sides of the second conductive portion 8'.

Figure 5B:
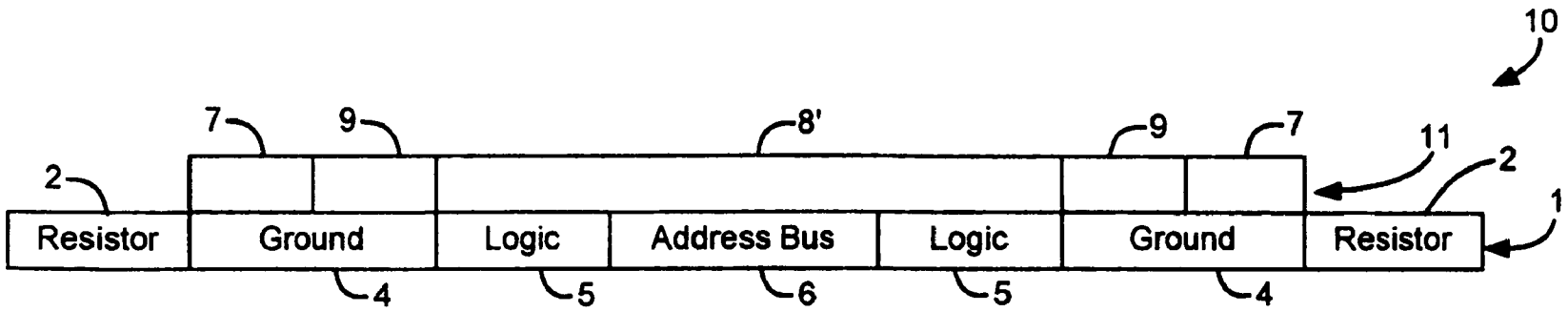

FIG. 5B illustrates a simplified illustration of the relative layout of metal layer portions in an exemplary embodiment of a thin film stack 10 of an exemplary fluid ejection device. The second metal layer 11 comprises power conducting portions 7 and 9. In an exemplary embodiment, the arrangement of FIG. 5A and the arrangement of FIG. 5B correspond to the arrangement in two different parts of the circuitry of a fluid ejection device. For example, the layout of the second metal layer 11 of FIG. 5A may correspond to the layout in those portions of the second metal layer 11 of FIG. 8 where the power conducting portions 7 and 9 are routed alongside each other. The layout of the second metal layer 11 of FIG. 5B may correspond to the layout in the portions of the second metal layer 11 of FIG. 8 where the power conducting portions 9 are routed beyond the ends of the power conducting portions 7.

By arranging the layout or topology of the first and second metal layers 1, 11 so that the power conducting portions 7 and/or 9 are not routed over the address path portion 6 and so that the second portion 8' is electrically isolated from the power conducting portions 7 and 9, the arrangements of FIGS. 5A and 5B reduce the opportunity for noise generation caused by capacitive coupling between power conducting portions and address path portions. Providing the second metal layer 11 with a second conductive portion 8' which comprises tantalum may reduce delamination of the second metal layer 11 from an overlying barrier layer.

Figure 9:
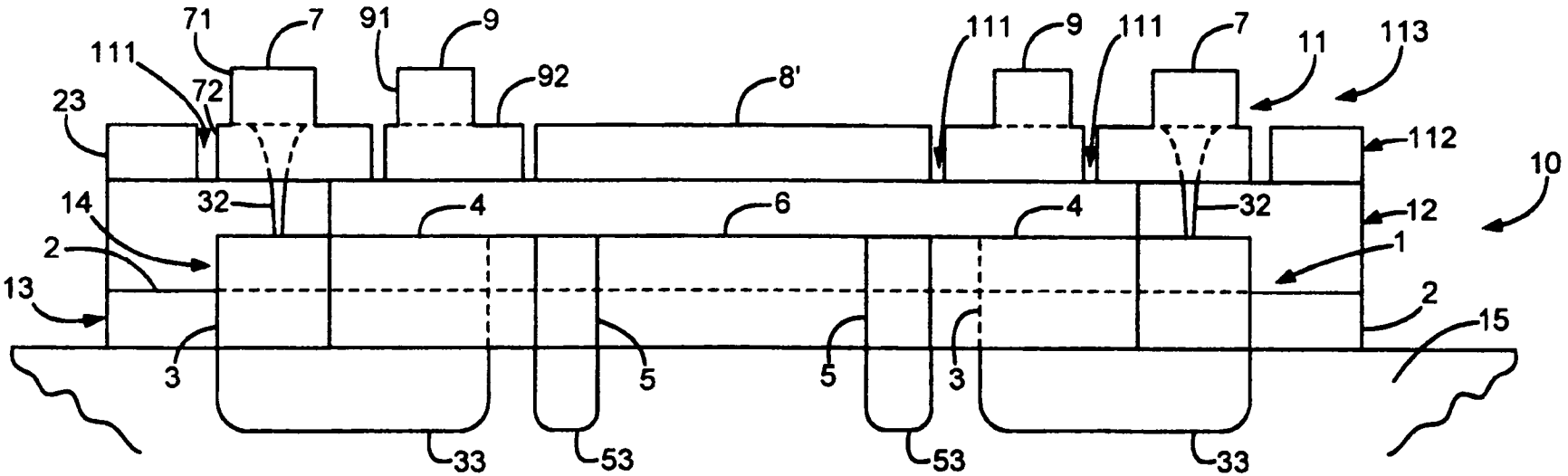
FIG. 9 is a block diagram of the relative positions of portions of an exemplary embodiment of a fluid ejection device.

FIG. 6 illustrates a simplified top view of an alternate, exemplary embodiment of a first metal layer 1 of a fluid ejection device. The first metal layer comprises an address path portion 6 and non-address path portions. The non-address path portions comprise resistor portions 2, transistor portions 3, first-metal-layer ground portions 4 and logic portions 5. The resistor portion 2 comprises a plurality of individual resistors 21 arranged in a column 22. The transistor portion 3 comprises drive transistor metal portions 31 of individual drive transistors associated with corresponding resistors 21, and which overlie the underlying drive transistors 33 (FIG. 9). Conductive vias 32 electrically connect the drive transistor portions 31 to overlying power conducting portions 7, 9 (FIG. 7).

The logic portions 5 overlie underlying logic elements 53 which are defined in the substrate structure 15 (FIG. 9). The logic portions are not located as close as possible to the transistor portions 3. The logic portions may be separated from the transistor portions 3 by a distance greater than 5 μm. In an exemplary embodiment, the logic portions 5 are about 65 μm wide and separated from the corresponding transistor portions 3 by about 134 μm. In other exemplary embodiments, the logic portions 5 may be separated from corresponding transistor portions by greater than 30 μm or greater than 100 μm. In the exemplary embodiment of FIG. 6, the first-metal-layer ground portion 4 extends over the underlying transistors 33 and comprises, in part, the transistor portion 3. In an exemplary embodiment, the first-metal-layer ground portion 4 is about 281 μm wide. In an exemplary embodiment, the address path portion 6 is about 139 μm wide.

Figure 7:
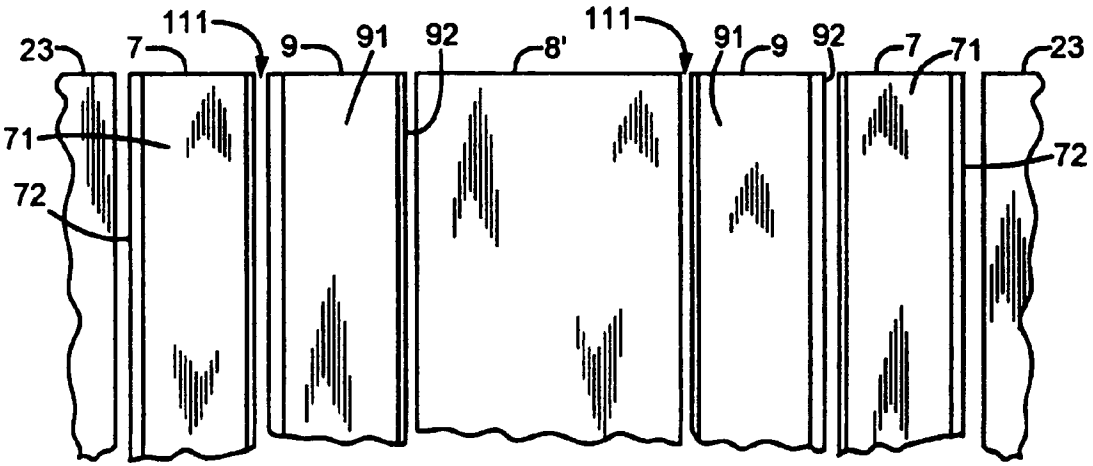
FIG. 7 illustrates an exemplary embodiment of a second metal layer of the fluid ejection device of FIG. 6.

FIG. 7 illustrates a simplified top view of an alternate exemplary embodiment of a second metal layer corresponding to the embodiment of the first metal layer shown in FIG. 6. The second metal layer comprises power conducting portions 7 and 9, which are defined by and comprise conductive layer portions 71, 91 of the second metal layer 11. The second metal layer also comprises second conductive portions 72, 92 and a second conductive portion 8' which overlies the address path portion and logic element portions 5 of the underlying first metal layer. In an exemplary embodiment, the second conductive portions 72, 92 may be wider than the corresponding, overlying conductive layer portions 71, 91, and may extend, for example, about 4 μm beyond the edges of the overlying conductive layer portions 71, 91. Second conductive layer portions 23 overlie the resistor portions 2 (FIG. 6) of the underlying first metal layer. The second conductive layer portions 23 may protect underlying resistors 21 from damage due to cavitation.

The second conductive portions 23, 72, 92 and 8' are separated by continuous gaps 111 in the second metal layer. The gaps 111 electrically separate the power conducting portions 7, 9 and their respective second conductive portions 71, 91 from one another. The power conducting portions 7 are electrically connected to underlying transistor portions 3 (FIG. 6) of the first metal layer by conductive power vias 32. The power conducting portions 7 provide power to the resistors corresponding to underlying drive transistors. The power conducting portions 9 are routed over the ground portions 4 to provide power to drive transistors and resistors further along the columns (FIG. 8).

Figure 8:
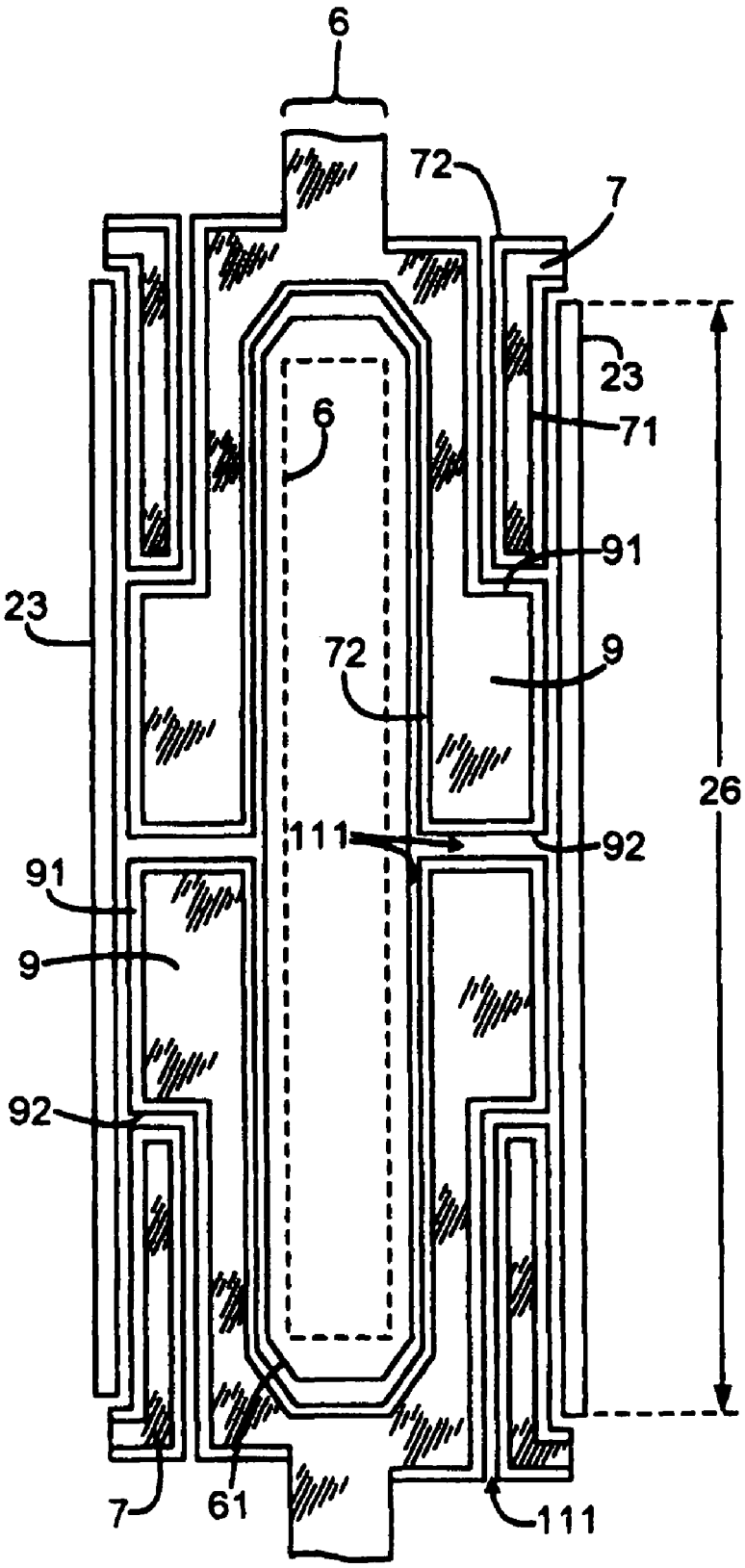
FIG. 8 illustrates an exemplary embodiment of a layout of a second metal layer of a fluid ejection device.

FIG. 8 illustrates an exemplary layout of the second metal layer 11 for the embodiments illustrated in FIGS. 5A-7. In this embodiment, the second metal layer 11 comprises six power conducting portions—four power conducting portions 7 and two power conducting portions 9, the power conducting portions being defined by conductive layer portions 71, 91 of the second metal layer 11. The second metal layer also comprises corresponding second conductive portions 72, 92 which extend beyond the edges of the conductive portions 71, 91 and second conductive portions 23, which overlies the resistor portion 2 (FIG. 6) of the first metal layer, and second conductive portion 8', which overlies the address path portion 6. The second conductive portions 72, 92 extend underneath the conductive portions 71, 91 in the power conducting portions 7, 9. The second conductive portions 72, 92 and 8' are separated by continuous gaps 111 in the second metal layer. In exemplary embodiments, the continuous gaps 111 may be from 8 μm to 20 μm.

Providing a second metal layer 11 with a second conductive portion 8' which comprises tantalum may reduce delamination of the second metal layer 11 from an overlying barrier layer. Providing a second metal layer 11 with second conductive portions 72, 92 which extend beyond the edges of conductive portions 71, 91 may prevent delamination of an overlying barrier layer from the second metal layer at the edge of the conductive portions, where the edge of the second metal layer 11 may be exposed. Delamination may be more likely to occur where gold is exposed at the edge of the conductive portions.

The four power conducting portions 7 are routed, at least in part, over non-address path portions. In the embodiment of FIG. 8, for example, the power conducting portions 7 are routed over at least those portions of the transistor portions and first-metal-layer ground portion 4 of an underlying first metal layer (not shown) which are associated with corresponding upper-and lower-most groups of resistors. The power conducting portions 9 are routed between the second conductive portions 71 and the respective power conducting portions 7. The power conducting portions 9 extend past the power conducting portions 7 to provide electrical power to groups of drive transistors and resistors toward the middle of the columns.

FIG. 9 illustrates relative positions of portions of the first metal layer 1, second metal layer 11 and drive transistors 33 and logic elements 53 in the substrate structure 15, for the exemplary embodiments of the exemplary layouts of FIGS. 5A-8. The first metal layer 1 comprises a conductive layer portion 14 and a resistive layer portion 13. The first metal layer 1 comprises resistor portions 2, drive transistor portions 3, first-metal-layer ground portions 4, logic element portions 5 and an address portion 6. The first metal layer 1 is formed over a substrate, which includes a gate oxide layer, PSG, poly and doped regions.

Drive transistors 33 and logic elements 53 are defined in the substrate structure below the drive transistor portions 3 and logic element portions 5 respectively. The logic elements 53 and transistors 33 are not spaced as close to each other as possible. The logic elements 53 and corresponding transistors 33 are separated by a distance greater than 5 μm. In an exemplary embodiment, the drive transistors 33 are about 216 μm wide and separated from corresponding logic elements 53 by 134 μm. Providing a separation between the transistor portion and the logic portion provides additional space for a wider ground portion 4, which may decrease ground resistance, thereby decreasing energy variation and improving performance of the fluid ejection device.

A passivation layer 12 separates the first metal layer 1 from the second metal layer 11. The second metal layer comprises a second conductive layer portion 112 and a first conductive layer portion 113. The second conductive layer portion 112 comprises second conductive portions 72, 92, 8' and 23. The second conductive portions 72 are routed over the drive transistor portions 3, the second conductive portions 92 are routed over the first-metal-layer ground portions 4, the second conductive portion 8' is routed over the address path portion 6 and the second conductive portions 23 are routed over the resistor portions 2.

The first conductive layer portion 113 comprises conductive portions 71, 91 which define and comprise power conducting portions 7, 9. The conductive portions 71, 91 are routed over the second conductive portions 72 and 92, respectively. In an exemplary embodiment, no power conducting portion is routed over the address path portion 6.

Figure 10:
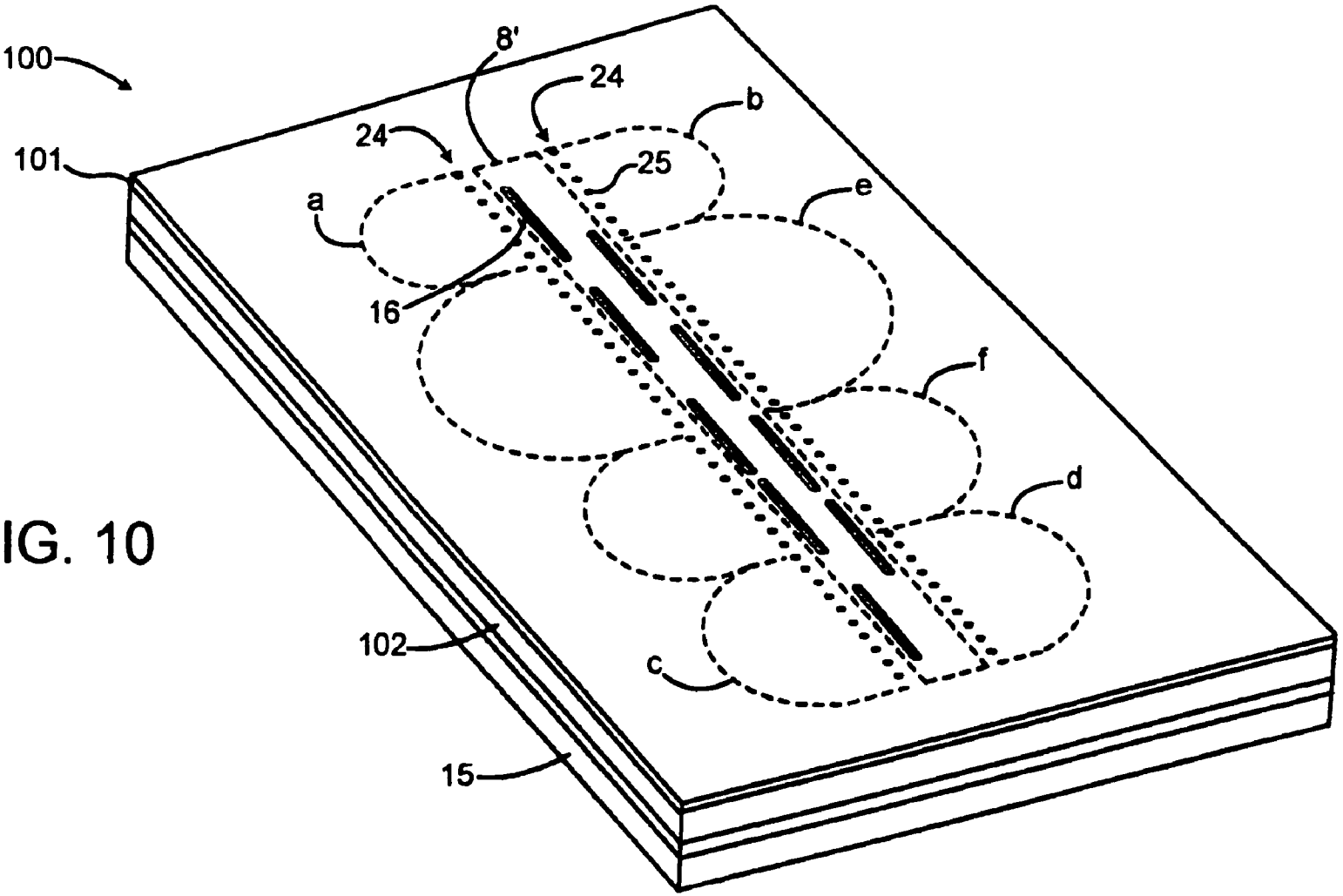
FIG. 10 illustrates a top view of an exemplary embodiment of a fluid ejection device.

FIG. 10 illustrates an isometric view of an exemplary embodiment of a fluid ejection device 100. The fluid ejection device comprises an orifice layer 101, a barrier layer 102 and a substrate structure 15. In an exemplary embodiment, the orifice layer 101 may comprise an orifice plate 101, which may comprise metal.

The orifice layer 101 comprises at least one column 24 of nozzles 25. In the embodiment of FIG. 10, two columns 24 of nozzles 25 are shown. It is understood that an orifice layer 101 may comprise more columns 24 of nozzles 25. Each nozzle 25 corresponds to a resistor 21 in an underlying first metal layer 11. The nozzles 25 may be arranged in primitive groups, the nozzles 25 of each group being powered by a common power conducting portion 7 or 9 (FIG. 8). In the exemplary embodiment of FIG. 10, the nozzles 25 are arranged in six groups a-f. Primitive groups a, b, c, and d correspond to nozzles 25, corresponding to resistors 21 which are powered by corresponding power conducting portions 7 of the second metal layer 11 of FIG. 8. The groups e and f correspond to nozzles powered by power conducting portions 9 shown in FIG. 8. FIG. 10 shows a representative number of nozzles in each group. It is understood that the number of nozzles can vary. In an exemplary embodiment, for example, the groups a, b, c and d can each include at least 28 nozzles and groups e and f can include at least 116 nozzles, 58 nozzles from each column 24.

In an exemplary embodiment, the orifice plate 101 may comprise openings 16 through the orifice plate. In an exemplary embodiment, the openings 16 overlie the second conductive portion 8' of FIG. 8, the outlines of which are shown by the dotted line 8'. The openings 16 may comprise an expansion grate which accommodates and reduces the likelihood of damage from thermal expansion. Arranging the expansion grates 16 such that they overlie the second conductive portion 8', instead of overlying gold, may reduce the likelihood of delamination between the barrier layer and the second metal layer. Providing a second metal layer in which the second conductive layer portions extend beyond the edges of the conductive layer portions may reduce the likelihood of problems caused by shorts and/or delamination.

It should be noted that the terms line, bus, or path apply to any conductive path that is of sufficient conduction to provide a signal path for a particular type of signal to propagate.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A fluid ejection device, comprising:

a first metal layer comprising an address path portion and a non-address path portion comprising a ground portion;

a second metal layer overlying the first metal layer and comprising a first power conducting portion having a first resistivity and a second conductive portion having a second resistivity which is greater than the first resistivity, wherein the first power conducting portion is routed over the non-address path portion and the second conductive portion is electrically isolated from the ground portion and electrically isolated from the first power conducting portion.

2. The fluid ejection device of claim 1, wherein the second conductive portion is routed over the address path portion.

3. The fluid ejection device of claim 1, wherein the second conductive portion comprises tantalum.

4. The fluid ejection device of claim 1, wherein:

the non-address path portion comprises a first transistor portion arranged generally parallel with the address path portion.

5. The fluid ejection device of claim 4, wherein the first power conducting portion is routed over the first transistor portion.

6. The fluid ejection device of claim 4, wherein the first metal layer comprises a first logic portion arranged between the address path portion and the first transistor portion.

7. The fluid ejection device of claim 6, wherein the second conductive portion is routed over the address path portion and over the first logic portion.

8. The fluid ejection device of claim 6, wherein the first logic portion is separated from the first transistor portion by at least 30 um.

9. The fluid ejection device of claim 6, wherein the first logic portion is separated from the first transistor portion by at least 100 um.

10. The fluid ejection device of claim 6, further comprising a logic element underlying the first logic portion and a corresponding drive transistor underlying at least in part the first transistor portion, wherein the logic element is separated from the corresponding drive transistor by at least 30 um.

11. The fluid ejection device of claim 10, wherein the logic element is separated from the corresponding drive transistor by at least 100 um.

12. The fluid ejection device of claim 6, wherein the first metal layer comprises a first ground portion arranged between the first logic portion and the first transistor portion.

13. The fluid ejection device of claim 5, wherein:

the non-address path portion further comprises a second transistor portion arranged generally parallel with the address path portion, the , address path portion being between the first transistor portion and the second transistor portion.

14. The fluid ejection device of claim 13, wherein the second metal layer further comprises a second power conducting portion routed over the second transistor portion.

15. The fluid ejection device of claim 1, wherein:

the second metal layer further comprises a second power conducting portion routed between the first power conducting portion and the second conductive portion.

16. The fluid ejection device of claim 15, wherein:

the second conductive portion is routed over the address path portion.

17. The fluid ejection device of claim 1, wherein:

the second metal layer further comprises a second power conducting portion and a third power conducting portion, the first and second power conducting portions being routed on first and second opposed sides of the second conductive portion, and the third power conducting portion being routed between the first power conducting portion and the second conductive portion on the first opposed side and between the second power conducting portion and the second conductive portion on the second opposed side of the second conductive portion.

18. The fluid ejection device of claim 17, wherein the first power conducting portion is electrically connected to a first primitive group of firing resistors in a first column of firing resistors;

the second power conducting portion is electrically connected to a second primitive group of firing resistors in a second column of firing resistors;

and the third power conducting portion is electrically connected to a third primitive group of firing resistors in the first and second column of firing resistors.

19. The fluid ejection device of claim 2, wherein the address path portion is one of a data path, select path, or enable path.

* * * * *

UNITED STATES PATENT AND TRADEMARK OFFICE

CERTIFICATE OF CORRECTION

PATENT NO. : 7,798,616 B2
APPLICATION NO. : 11/811094
DATED : September 21, 2010
INVENTOR(S) : Kevin Bruce et al.

It is certified that error appears in the above-identified patent and that said Letters Patent is hereby corrected as shown below:

In column 10, line 4, in Claim 13, delete “the ,” and insert -- the --, therefor.

Signed and Sealed this
Eighth Day of March, 2011

David J. Kappos

David J. Kappos
*Director of the United States Patent and Trademark Office*